United States Patent [19]

Rocha

[11] 4,393,746

[45] Jul. 19, 1983

[54] AMMUNITION MAGAZINE WITH BUILT-IN COMPARTMENT COVERS

[75] Inventor: John G. Rocha, Dover, N.J.

[73] Assignee: The United States of America as represented by the Secretay of the Army, Washington, D.C.

[21] Appl. No.: 288,826

[22] Filed: Jul. 31, 1981

[51] Int. Cl.[3] ..... F41D 10/14
[52] U.S. Cl. ..... 89/34
[58] Field of Search ..... 89/33 BB, 33 BC, 34; 206/3

[56] References Cited

U.S. PATENT DOCUMENTS 3,461,774 8/1969 Maurer et al. ..... 89/34

*Primary Examiner*—Stephen C. Bentley
*Attorney, Agent, or Firm*—Robert P. Gibson; Anthony T. Lane; A. Victor Erkkila

[57] ABSTRACT

An ammunition magazine has several compartments formed by vertical separators for holding rounds linked by a belt. A compartment cover is rotatably mounted to each vertical separator for either opening or closing an associated compartment. Each compartment cover has an opened position when the rounds are disposed inside its associated compartment, and a closed position when the associated compartment is emptied of the rounds.

7 Claims, 3 Drawing Figures

AMMUNITION MAGAZINE WITH BUILT-IN COMPARTMENT COVERS

GOVERNMENTAL INTEREST

The invention described herein may be manufactured, used and licensed by or for the Government for Governmental purposes without the payment to me of any royalty thereon.

BACKGROUND OF THE INVENTION

1. Field of the Invention

This invention relates generally to the field of ammunition magazines and more specifically to ammunition magazines having built-in compartments.

2. Background of the Invention—Prior Art

Ammunition magazines for holding belted rounds or cartridges are known. The magazines are generally partitioned by straight vertical separators forming individualized compartments. Each compartment holds several rounds which are linked by a belt in a generally U-shaped configuration. The same belt loops into-and-out of each compartment thus linking all the rounds in the magazine. As the belt is pulled by a gun, for example, each round is sequentially drawn out of its compartment and eventually out of the magazine exit. In this manner, one compartment is emptied first, then a second compartment, and so on, until all rounds have been drawn out of the magazine exit.

Such ammunition magazines are deficient in many respects. The linked rounds have a tendency to catch on the vertical separators and become entangled in previously emptied compartments, as the rounds are drawn toward the compartment exit. Moreover, belt pulling forces are not constant, since low force is required to pull the belt out of compartments positioned close to the exit, but greater force is required for compartments positioned far from the exit. Consequently, it is difficult to keep control over the ammunition and achieve a uniform firing rate for the entire feed cycle of the belt.

It is, therefore, an object of this invention to provide an ammunition magazine without the above shortcomings.

A further object of this invention is to provide an ammunition magazine which is easy to load and reload, and only requires low belt pulling forces throughout the full feed cycle.

Still another object of this invention is to provide an ammunition magazine which is low in cost and simple to manufacture.

SUMMARY OF THE INVENTION

An ammunition magazine has several compartments formed by vertical separators for holding rounds linked by a belt. A compartment cover is rotatably mounted to each vertical separator for either opening or closing an associated compartment. Each compartment cover has an opened position when the rounds are disposed inside its associated compartment, and a closed position when the associated compartment is emptied of the rounds. The rounds are pulled out of the compartment by the linked belt which actuates the compartment cover to the closed position.

DESCRIPTION OF ILLUSTRATIVE EMBODIMENT

Figure 1:
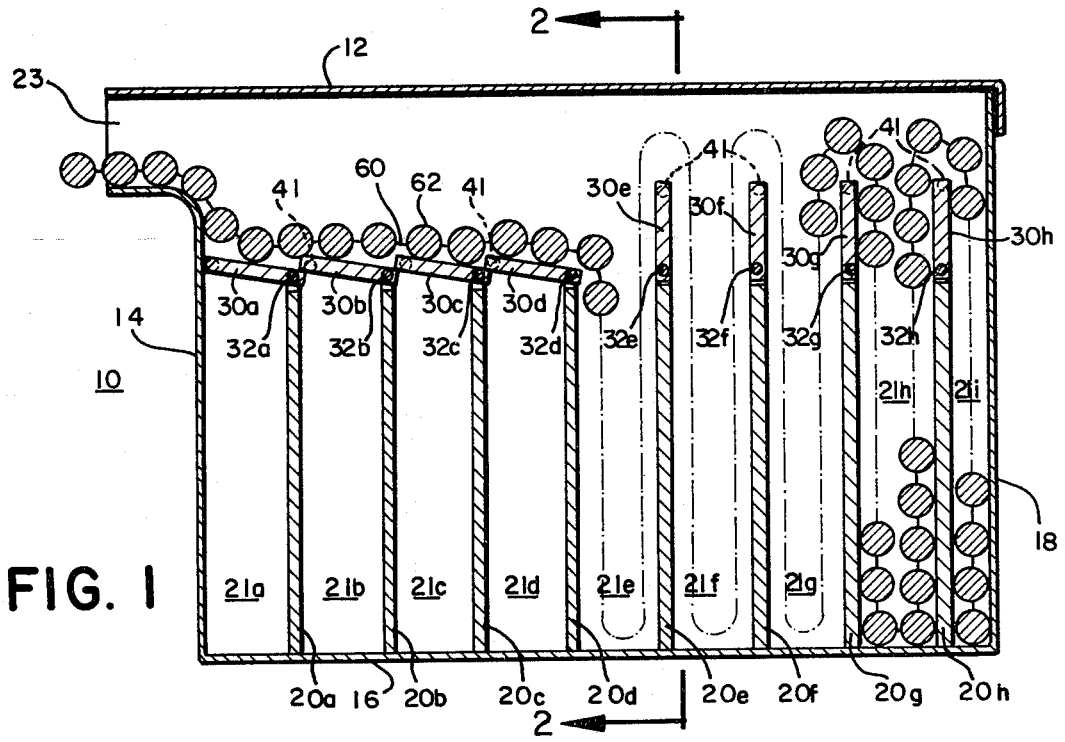
FIG. 1 is a sectional view of an ammunition magazine with built-in compartments having hinged cover plates made in accordance with this invention, and containing several rounds linked by a belt.
Figure 2:
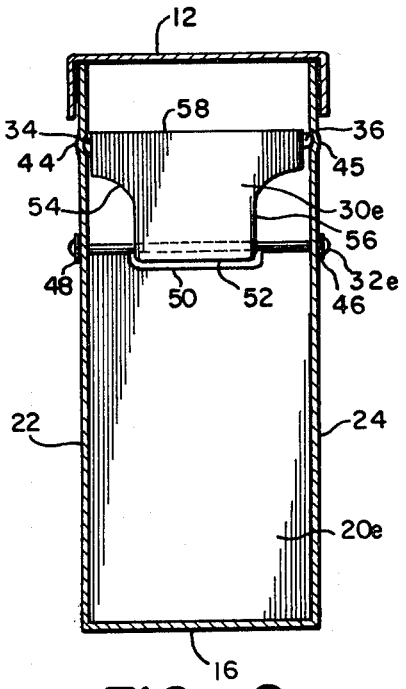
FIG. 2 is a view taken along line 2—2 of FIG. 1 with the rounds removed.

Referring to FIGS. 1 and 2, there is shown ammunition magazine 10 having several vertical separators 20*a–h* to form individualized compartments 21*a–i*. Ammunition magazine 10 is a box-like in shape having four walls 14, 18, 22 and 24 for forming the four vertical peripheral surfaces, respectively, and bottom floor 16 and top cover 12 for forming the lower and upper horizontal peripheral surfaces, respectively. It will be understood that top cover 12 may be easily removed by the armorer lifting the cover off the magazine, thereby exposing compartments 21*a–i*.

Also shown in FIG. 1 is magazine exit 23 formed between the upper portion of vertical wall 14 and top cover 12. Magazine exit 23 may be constructed, of course, in many ways. By way of example, shown in FIG. 1 is a spout arrangement constructed by bending the upper portion of vertical wall 14 in a direction away from the interior of magazine 10, so that the upper portion is substantially parallel to top cover 12. Magazine exit 23 provides an opening through which rounds 62, linked by belt 60, may be pulled out of magazine 10. Such pulling may be done in a conventional manner by force supplied from a gun (not shown) or an ammunition booster (not shown) or other pulling means (not shown).

The linked rounds are loaded into magazine 10 by lifting top cover 12 and dropping the linked rounds into compartments. The armorer may select compartments by opening or closing one or more of the compartment covers 30*a–h*. Compartment covers 30*a–h* are hinged on pins 32*a–h*, which in turn are disposed at the upper portion of vertical separators 20*a–h*, respectively. The compartment covers will be described in detail later.

By way of example, FIG. 1 shows compartments 21*a–d* closed, having compartment covers 30*a–d* in the closed position; and compartments 21*e–i* are opened, having compartment covers 30*e–h* in the open position. No cover is provided for the last compartment 21*i*, for reason that will become obvious later.

As shown in FIG. 1, the linked rounds form a continuous chain, starting from the exterior (not shown) of ammunition magazine 10, through magazine exit 23, then resting upon closed compartment covers 30*a–d*, then looping into-and-out of compartments 21*e–h* in a generally U-shaped configuration, then finally dropping into the last compartment 21*i*. In operation, the linked rounds are pulled through magazine exit 23. As pulling continues, the rounds in compartment 21*e* are successively pulled out. Upon the emptying of compartment 21*e*, the pulling force coupled with the weight of the linked rounds in compartment 21*f* actuates compartment cover 30*e* to the closed position. In this manner, the rounds disposed in the remaining open compartments cannot catch on the vertical separator and become entangled in the previously emptied compartment. In similar fashion, as pulling continues, compartment 21*f* is emptied and then cover 30*f* is actuated to the closed position. Next, compartment 21*g* is emptied, and then cover 30*g* is closed; and so on, until all the compartments have been emptied. It will be noted that the last compartment 21*i* does not require a cover, since there is no possibility of remaining rounds in magazine 10 becoming entangled in the last compartment.

The compartment covers will now be described in greater detail. Since all the covers are identical, only one cover (by way of example cover 30*e*) need be described. Referring to FIG. 2, there is shown cover 30*e* in relation to vertical separator 20*e*. Cover 30*e* is secured in a conventional manner by way of pin 32*e* to vertical walls 22 and 24 immediately above the upper portion of vertical separator 20*e*. The longitudinal dimension of pin 32*e* is in alignment with vertical separator 20*e*, providing a span from vertical wall 22 to vertical wall 24. Pin 32*e* is mounted between walls 22 and 24 through pin guides 46 and 48 in a conventional manner. The alignment of vertical separator 20*e* and cover 30*e* is such that a substantially continuous surface is formed from the lower portion of vertical separator 20*e*, through the upper portion of vertical separator 20*e*, to neck 52 of cover 30*e*, and finally up to shoulders 58 of cover 30*e*.

As shown in FIG. 2, neck 52 is arranged to engage recessed portion 50 of separator 20*e* so that cover 30*e* in its fully opened position may form a single vertical plane with separator 20*e*. When rotated to its closed position, cover 30*e* pivots counter-clockwise toward magazine exit 23, as shown in FIG. 1. In its fully closed positon, cover 30*e* extends in a direction substantially perpendicular to vertical separator 20*e*.

Figure 3:
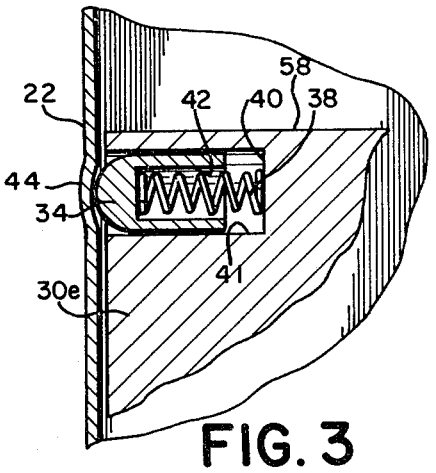
FIG. 3 is a sectional view of the spring-loaded plunger for the hinged cover plate of FIG. 2.

In order to permit a stable opened position for cover 30*e*, shoulders 58 are provided with spring-loaded plungers 34 and 36 for mating with wall-detents 44 and 45, respectively. Spring-loaded plunger 34 is shown in greater detail in FIG. 3. As shown, bore 41 of shoulder 58 is effective to receive plunger 34. Spring 38, inserted in recess 42, is effective, while pushing against inside bore-wall 40, to bias plunger 34 toward detent 44. It will be understood that the bias on spring 38 may be predetermined to effectively maintain cover 30*e* in the opened position when compartment 21*e* is loaded with rounds, but permit plunger 34 to move into bore 41 when the pulling force, provided by the linked belt, is sufficient to actuate cover 30*e* to its closed position. If desired, detents similar to wall detents 44 and 45 can be provided to maintain cover 30*e* in the closed position.

In order to permit a stable closed position for cover 30*e*, shoulders 58 are extended radially from pin 32*e* with a length greater than the length between vertical separators. In this manner, upon rotating to its closed position, cover 30*e* may be effectively stopped by its neighboring cover, cover 30*d*, which is closer to exit 23.

In loading magazine 10, the armorer may easily rotate each compartment cover to its opened position. This is facilitated by grasping cover 30*e*, for example, at cutout sections 54 and 56, shown in FIG. 2. As shown, cutout sections 54 and 56 are formed by connecting neck 52 to shoulders 58. Although cutout sections 54 and 56 may have various forms, in this embodiment they are parabolically-shaped contours.

It will be understood that magazine 10 may be constructed of metal or any other material suitable for the operating environment of the ammunition.

I claim:

1. An ammunition magazine comprising a plurality of compartments formed by vertical separators for holding rounds linked by a belt and at least one compartment cover, said compartment cover rotatably mounted immediately above one of said vertical separators for either opening or closing one of said compartments, said compartment cover having an opened position when said rounds are disposed inside said one of said compartments and a closed position when said one of said compartments is emptied of said rounds, wherein said compartment cover is radially extended from said one of said vertical separators forming a substantially continuous surface with said one of said vertical separators, and said compartment cover forming a single vertical plane with said one of said vertical separators when in said opened position, and extending in a direction substantially perpendicular to said one of said vertical separators when in said closed position.

2. The ammunition magazine of claim 1, wherein said cover extends with a greater length than the length between neighboring vertical separators so that when it is in closed position it is stopped by its neighboring cover.

3. The ammunition magazine of claim 1 wherein there is provided an ammunition exit for pulling said rounds by said belt through said ammunition exit, and actuating means for actuating said compartment cover to the closed position when said one of said compartments is emptied of said rounds.

4. The ammunition magazine of claim 3 wherein said actuating means includes said belt looping into-and-out of said one of said compartments in a generally U-shaped configuration and then looping into another of said compartments, said one of said compartments located closer than said other of said compartments from said ammunition exit, whereby when said rounds are emptied out of said one of said compartments, then said actuating means actuates said compartment cover to the closed position.

5. The ammunition magazine of claim 4 wherein said compartment cover is comprised of a neck engaging said one of said vertical separators, said neck extending radially outward to form shoulders and parabolically-countoured cutout sections for manually rotating said compartment cover.

6. The ammunition magazine of claim 5 wherein said shoulders include a recess for receiving a spring-loaded plunger, said spring-loaded plunger being biased to maintain said compartment cover in the opened position when said rounds are disposed inside one of said compartments.

7. The ammunition magazine of claim 4 wherein said actuating means rotates said compartment cover in the counter-clockwise direction.

* * * * *